US005395110A

United States Patent [19]

Yamazaki et al.

[11] Patent Number: 5,395,110

[45] Date of Patent: Mar. 7, 1995

[54] GAME MACHINE AND GAME PARLOR

[75] Inventors: Shunpei Yamazaki, Tokyo; Akiharu Miyanaga; Toshiji Hamatani, both of Kanagawa, all of Japan

[73] Assignee: Simiconductor Energy laboratory Co., Ltd., Kanagawa, Japan

[21] Appl. No.: 139,733

[22] Filed: Oct. 22, 1993

[30] Foreign Application Priority Data

Oct. 22, 1992 [JP] Japan ..... 4-308327

[51] Int. Cl.[6] ..... A63F 7/00

[52] U.S. Cl. ..... 273/108; 273/118 R; 273/118 A; 273/121 B; 273/138 R

[58] Field of Search ..... 273/118–125, 273/85 G, 138 R, 138 A, 142, 143, 108

[56] References Cited

U.S. PATENT DOCUMENTS 4,964,638 10/1990 Ishida ..... 273/143 R X 5,004,238 4/1991 Ikada ..... 273/121 B 5,201,321 4/1993 Fulton ..... 128/702

FOREIGN PATENT DOCUMENTS 8601317 2/1986 WIPO ..... 273/85 G

*Primary Examiner*—Raleigh W. Chiu

*Attorney, Agent, or Firm*—Sixbey, Friedman, Leedom & Ferguson

[57] ABSTRACT

A game machine enabled to make various responses by adding the psychosomatic state and emotion of the player as one of conditions for determining the responding manner. The psychosomatic state of the player is grasped to change the responses in accordance with the psychological state of the player by making use of both a chaos attractor obtained by numerically processing the information sampled from the player and the index indicating the degree how the chaos attractor matches the defining condition of the chaos.

20 Claims, 3 Drawing Sheets

GAME MACHINE AND GAME PARLOR

BACKGROUND OF THE INVENTION

Field of the Invention

The present invention relates to a novel game machine that responds to the psychosomatic state of a player and, more particularly, to a 'pachinko' machine that uses pachinko balls or a rotary drum type game machine that has a rotary drum type graphic pattern combining unit, hereinafter referred to as a slot machine or "pachislo".

Description of the Relevant Art

Generally speaking pachinko machines that use pachinko balls are widely known, and pachinko parlors are currently conducting business as one of the most popular amusements throughout Japan.

In a pachinko game, the player buys some pachinko balls and shoots them by using a shooting grip on the pachinko machine. If, through luck, one of the balls lands in a rewarding catcher, the player is rewarded with more balls. Recently, the shooting grip of the pachinko machine has been designed to allow the shooting of balls continuously through the use of an electromechanical device. All that is required of the player is to turn the shooting grip. This has the tendency, however, to make the pachinko game monotonous. Thus, in order to promote the interest of the player and to reward all players impartially with rewarding balls, there has been developed and implemented a pachinko machine which is equipped with a game machine that incorporates a game factor.

If predetermined conditions are satisfied, this pachinko machine starts the game machine to determine the responses to be taken by the pachinko game and to control the operation of the game machine so that the player can enjoy more advantageous game conditions. A pachinko machine of this type is popular because players can be rewarded with more balls independently of their skill.

As electronics technology progresses, recent pachinko machines are equipped with numerous CPU control units. Specifically, the game machine within the pachinko machine is substantially electronically operated, and this operation is controlled by the CPU, i.e., the so-called "microprocessor" or computer. This computer serves the purpose of receiving various pieces of information from the pachinko machine itself or its game machine, computing results based on the receipt of such information, and controlling the pachinko machine so as to cause it to complete a predetermined operation or series of operations according to a predetermined procedure, or program. However, this only requires that the machine side of the pachinko machine be implemented electronically, and thus the player can only await a decision made by the computer.

Along with pachinko machines, a rotary drum type game machine (as is generally called a "slot machine" or "pachislo") having a rotary drum type graphic pattern combining unit has recently grown popular as an interesting amusement. The player of a drum type game machine inserts a coin into the slot and pushes a start button to cause the rotation of the graphic patterns of the drum so that he or she may be rewarded with more coins in accordance with the combination of the patterns.

This game machine is also equipped with numerous computer control units resulting from the recent progress in electronics technology. Specifically, the rotary drum type graphic pattern combining unit is substantially operated by the technology, and this operation is controlled and determined by the computer or microprocessor. The function of this microprocessor is to process various pieces of information obtained from the game machine and pattern combining unit, and to control the operation of the game machine in accordance with a predetermined procedure, or program. This, however, also has the tendency to result in monotonous play as with a pachinko machine.

The electronic components of the pachinko machine and drum type game machine described above result in more variety during play than those of the existing game machines. Despite this variety, however, the player will still lose interest after a short period, just as with prior art game machines. This results because the operation of the machines grows monotonous since the responses simply follow a predetermined procedure or program. Human players, however, have their emotions, senses, health conditions and psychosomatic states, which all change over time, and therefore they will lose interest in a game machine having consistent and unchanged operation in the machine side.

SUMMARY OF THE INVENTION

In order to solve the problems of the prior art the present invention has an object to provide a game machine which is capable of making various responses and changes in operation by taking into account the psychosomatic state and emotion of the player as one of the conditions for determining the game operation.

According to a first aspect of the present invention, there is provided a game machine wherein the psychosomatic state of a player is detected to change the game machine operation in accordance with the psychological state of the player. The detection of the psychosomatic state of the player makes use of both a chaos attractor obtained by numerically processing information sampled from the player and an index indicating the degree that the chaos attractor matches a defining condition of chaos.

According to a second aspect of the present invention, there is provided a game machine comprising: a psychosomatic state detecting system including a sensor for detecting data from a player, a chaos attractor generator for calculating a chaos attractor by numerically processing the data detected by the sensor, and a Ljapunov index calculator for calculating an index that indicates the degree that the chaos attractor matches a defining condition of chaos; and changing means for changing the operation of the game machine in accordance with the information that indicates the psychosomatic state of the player calculated by the system.

According to a third aspect of the present invention, there is provided a game parlor comprising: a plurality of pachinko machines each comprising a psychosomatic state detecting system including a sensor for detecting data from a player, a chaos attractor generator for calculating a chaos attractor by numerically processing the data detected by the sensor, and a Ljapunov index calculator for calculating an index indicating the degree that the chaos attractor matches a defining condition of chaos; and changing means for changing the environmental surroundings of the players or pachinko machines, such as the kind, volume or tone quality of music in the parlor, or the brightness, hue or color of illuminations in accordance with the information indicating the psychosomatic states of the players detected from the pachinko machines.

According to a fourth embodiment of the present invention, there is provided a game machine wherein the emotions and other characteristics of a player indicative of the physcosomatic state of the player are assigned to a plurality of predetermined levels by utilizing the information sampled from the player, such that the operation of the game machine may be changed according to one of the levels.

The game machine may comprise a rotary drum type graphic pattern combining unit.

As described above, according to the present invention, the psychosomatic state of a player is detected by comparing a chaos attractor peculiar to the player, which is obtained by numerically processing the information from the player, and a condition defining chaos whose attractor data are already known and subjected to a predetermined classification, so that the operation of the pachinko machine may be changed according to the psychological state of the player, thereby preventing the game from growing monotonous or the player from losing interest.

Moreover, a more comfortable and less firing game parlor is provided by changing the playing environment or optimizing the environment in accordance with the present emotional state of the player.

In another game machine in accordance with the present invention, the present emotions or psychosomatic state of the player are assigned to a plurality of levels on the basis of the information which is obtained from the player even if it does not satisfy the concept of chaos, so that the operation of a game machine may be changed in accordance with the levels.

What "chaos" is will first be described. In a natural world, as well as an artificial world, there are many predictable phenomena. The position of Halley's comet or an artificial satellite can be predicted and a response taken according to the predicted position. The deterministic predictability that results when the cause-result relation is clear is one of the greatest powers of science.

However, even though a weather forecast seems to be based on the motion of air that follows the fundamental rules of physics, such weather forecast will not always be accurate. However, even phenomena having an unclear cause-result relation and believed to have random elements can be accurately predicted if complete information describing the system is available. That is, if information about the system can be sufficiently collected, a clear cause-result relation can be found and the outcome of the system predicted with accuracy.

In short, random phenomena are thought to be the result of a shortage of information about a system having multiple degrees of freedom. It has, however, been discovered that there are some phenomena which are deterministic but have the appearance of being random. This is shown by the discovery that even a simple system having a small number (e.g., three or more) of degrees of freedom may exhibit random behavior. Since this discovery, this random phenomenon has been called "chaos."

Despite this fact, however, the concept of chaos is not yet unified. Like the theory of evolution, the definition of chaos covers a wide range, and its concept for some objects seems to stand by itself. Hence, we will summarize the concept in the following manner.

Chaos shall mean an essentially random phenomena that is the result of a system which, although it has deterministic rules, experiences seriously complex nonlinear behavior. It is also believed that any phenomena that appears to have neither regularity nor predictability is backed by complex orders or rules.

On the other hand, the topology characterizing the behaviors of chaos is called the "chaos attractor", i.e., a mathematical structure into which converge the behaviors of the system generating chaos.

For example, pulse waves detected from human bodies are known to exhibit chaos behavior and characteristics. In the academic society, it has been reported by one of the authorities in this field that the apex pulse waves indicate the psychosomatic information of chaos. He also has applied for a Japanese patent in which medical diagnosis makes use of chaos (as disclosed in Japanese Patent Laid-Open No. 208136/1992).

Thus, the present invention is an apparatus which makes use of the correlation between the chaos attractor obtained by numerically processing the pulse waves, the heartbeat, bodily temperature or other physical characteristics representative of a person's emotions or psychosomatic state sampled from the body and a Ljapunov number indicating the degree that the data matches the defining conditions of chaos. Any other information can be used if it has a correlation with the psychosomatic state of the player.

Therefore, the emotion or psychosomatic state of the player is obtained by generating the chaos attractor which is obtained by numerically processing the pulse waves, heartbeats, bodily temperature or other physical attribute sampled from the player. Thus, the psychosomatic state of the player can be determined from the Ljapunov number indicating the degree that the data matches the defining conditions of chaos. The means for sampling the physical attributes of a player is exemplified by either a sensor combining an infrared-emitting diode and a photo-sensor or a semiconductor pressure sensor.

The relationship between the psychosomatic state and the chaos attractor of the physical attributes, such as apex pulse waves, is summarized as follows:

(1) The chaos attractor of the apex pulse waves reflects the mental and psychological states with sufficient sensitivity to indicate a specific topology;

(2) The chaos attractor obtained from the pulse waves has a personally peculiar structure over a basic structure common to the human being and changes according to the mental and psychological state and as a result of a disease;

(3) Generally speaking, when the mental and psychological states become unstable or when a disease occurs, the overall structure of the attractor becomes simple and small. Moreover, a mechanical and monotonous periodic structure appears in the rhythm that departs from chaos;

(4) In the healthy state, the overall structure is complex and dynamic, and the local structure also exhibits a complex structure such as rolled, twisted or screwed structures. Also, the rhythm becomes aperiodic. In short, the healthy mode is chaotic and is fully occupied by chaos; and (5) If the consciousness is concentrated, the chaos attractor is complicated to have the rolled or twisted local structure. On the other hand, if a stress higher than a threshold value is received such that the individual is fatigued, the structure is simplified and the local structure is lost.

According to the concept described above, the present emotional state of the player is classified into several categories according to which the operation of the pachinko machine or the rotary drum type game machine can be made to vary in order to provide more complicated game content and operation. Moreover, since the emotional state of the player changes over time, the interest of the player can be retained by changing the operation of the pachinko machine or the game machine accordingly.

The simplest and most preferable portion of the body for obtaining the psychosomatic information of the player used to calculate the chaos attractor is the fingertip, palm or arm of the player, and the selection of the most appropriate location depends upon the shape of the machine being used. The portion of the body to be used to obtain the required physical information should not be limited in the present invention to the ones specified above, but may include by any other portion of the body such as the head, buttock or skin of the player.

Likewise, the sensor to be disposed in the game machine can be mounted in various locations such as, for example, the ball shooting grip, the ball feed chute, the frame of the machine, or the seat of the player. If it is desired that an existing machine be modified, the most convenient and inexpensive portion of the machine to place a sensor on is the ball shooting grip or the frame of the machine. Thus, the information of the player can be easily obtained by mounting the aforementioned photo-coupler or semiconductor pressure sensor in that location.

The physical characteristic information of the player thus obtained is arithmetically processed, and it is determined whether the processed information matches a predetermined level. The Ljapunov index is then calculated according to the degree that the information matches the state of chaos. This numerical processing and the calculation of the Ljapunov index are performed by a computer, but the processing method and the expression of the processed chaos attractor are not especially restricted in their calculating equations or processing procedures but can be arbitrarily expressed and processed.

On the other hand, the predetermined levels for calculating the Ljapunov index can be set in many manners according to the number and classification of the chaos attractor. If the levels are only set to the "excited state" and the "unexcited state", then only two levels are required. If additional levels are added to represent "concentrated consciousness" and "distracted consciousness," then four levels are required. Since the responses of the play of the game machine are changed according to those four levels, the play content and variety are enriched.

The operation of the machine on the basis of the information obtained from the player can vary over a wide range in the case of the pachinko machine, including: the operations concerning the provision of rewarding balls, e.g., the adjusting of the opening of the great-hit catcher after the lucky great-hit condition is satisfied, the change of the great-hit condition, the interval of opening the great-hit catcher; the visual and auditory environmental conditions surrounding the player or produced by the machine, e.g., the kind of music or sound produced by the machine during play, and the color, brightness, or hue of the display on the play board face of the machine; a change in the operation of the ball shooter, e.g., a change in the initial velocity of the shot balls, the interval between balls during continuous shooting, the turning stroke of the shooting grip; or a change in the circumstances for installing the machines. Also, other various responses can be incorporated into the range of the present invention.

Since the changes in the responses of the pachinko machine fall within a range that does not decrease the probability of rewarding the player with additional balls, the player can enjoy the change in the play of the machine that responds to the present psychosomatic state.

The description above is directed to the application of the concept of chaos to a single game machine, but the concept can naturally be applied to an entire game parlor provided with a plurality of such machines.

Specifically, the psychosomatic states of the players using pachinko machines or rotary drum type game machines are detected and used to control the environmental conditions in the game parlor, such as the kind, volume or tone quality of music to be played in the game parlor, or the brightness, color, or hue of lighting and illuminations in the parlor. The music or lighting can be altered on the basis of the detected psychosomatic states of the players either for the entire game parlor or for only a section of the game parlor that corresponds to the distribution of the players in a specific psychosomatic state. Thus, the game parlor is featured by promoting the interests of the players in the game to allow the players to enjoy the game under more comfortable circumstances.

Moreover, the description above is directed mainly to such information that is obtained from the player and that can be representative of chaos. Even if, however, this concept is not applied to the information detected from the player, the operation of the game machine and the playing goals can be assigned to predetermined levels so that the operation of the machines can be altered according to the levels to complicate the game, and therefore to attract and maintain the interests of the players.

Specifically, a temperature sensor is used to measure the present body temperatures of the players, and these temperatures are assigned to predetermined levels. Specifically, four levels are determined in advance to have ranges of no higher than 36° C., higher than 36° C. but no higher than 36.5° C., higher than 36.5° C. but no higher than 37° C., and higher than 37° C., so that the operation of the machine can be changed depending upon which of those four levels the body temperature of the person playing the machine falls within.

Not only can the aforementioned body temperature be used, but also the pulse rate, the respiration rate, the surface temperature of the face or the body weight of the player can be employed to vary the operation of the game machine whether or not it falls within the concept of chaos.

BRIEF DESCRIPTION OF THE DRAWINGS

Other objects, features and advantages of the present invention will become apparent from the following description to be made in connection with the embodiments with reference to the accompanying drawings, in which.

DESCRIPTION OF THE PREFERRED EMBODIMENTS

Embodiment 1

Figure 1:
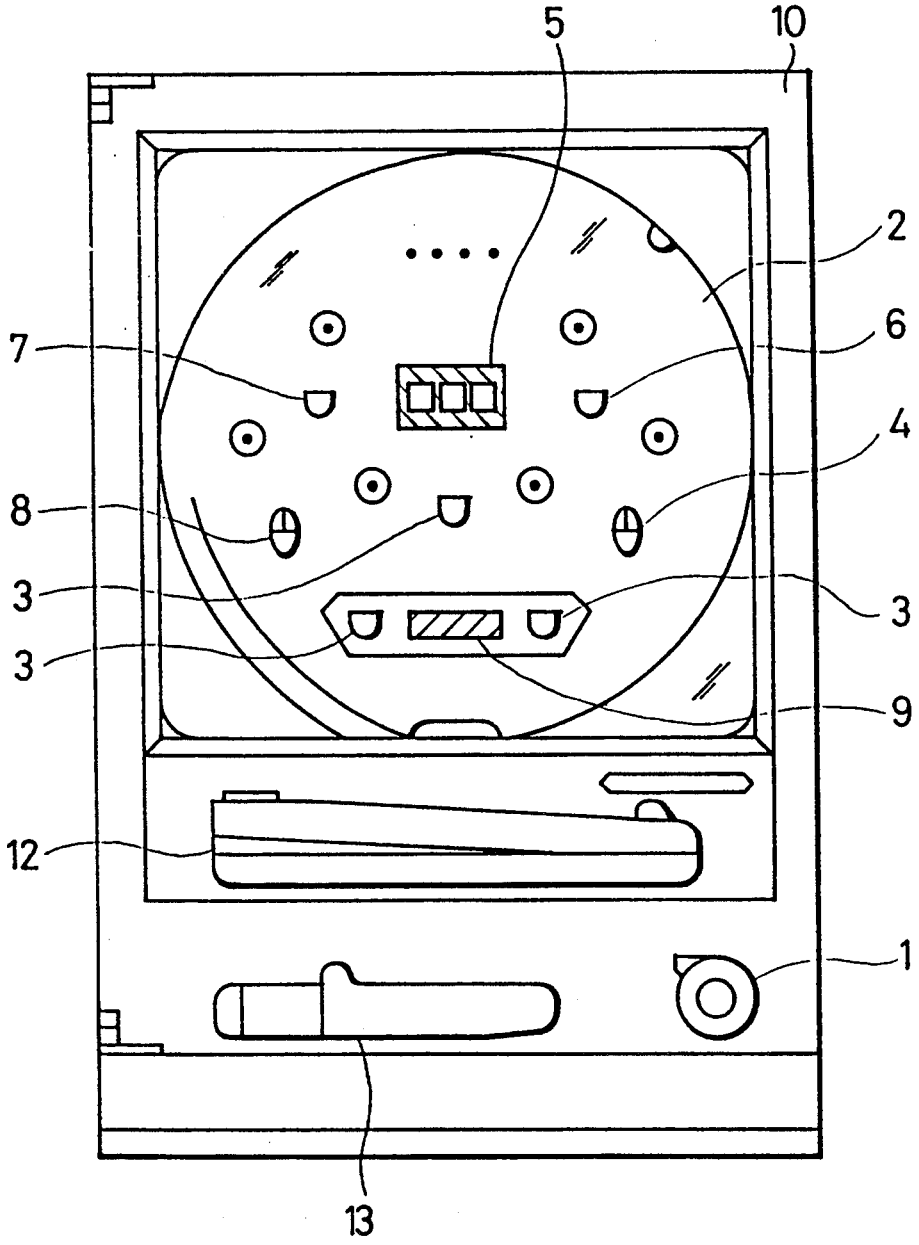
FIG. 1 is a schematic front elevation showing a pachinko machine according to the present invention.

The present embodiment will be described where the concept of chaos of the present invention is applied to a 'pachinko' machine. FIG. 1 is a schematic diagram showing the pachinko machine of the present embodiment.

Reference numeral 1 designates a ball shooting grip, and numeral 2 designates a playing board face, which is equipped therein with rewarding catchers 4, 6, 7 and 8, a game indicator 5, rewarding catchers 3 having functions to start the game unit, and a great-hit catcher 9. The pachinko balls shot by the shooting machine are bounced in various directions to fly downward over the board face 2 by nails arranged in the board face 2.

When the pachinko ball lands in any of the rewarding catchers 3, 4, 6, 7 and 8, reward balls are supplied to a ball feed/reserve chute 12. Especially when a ball lands in the rewarding catcher 3, a game unit is started in addition to the supply of reward balls. This game unit changes the indication of three figures in the game indicator 5 and interrupts the changes after the lapse of a predetermined time period. The game unit controls the opening of a control valve for the great-hit catcher 9, and instructs the great-hit catcher 9 to open if a predetermined combination of figures is achieved in the game indicator 5. If this special condition is attained, the great hit causes the pachinko machine to open the great-hit catcher 9 thereby establishing a situation in which the player can take advantage of catching more pachinko balls.

As shown in FIG. 1, the pachinko machine is generally identical, without any substantial change in appearance, to those used in the prior art.

Figure 4:
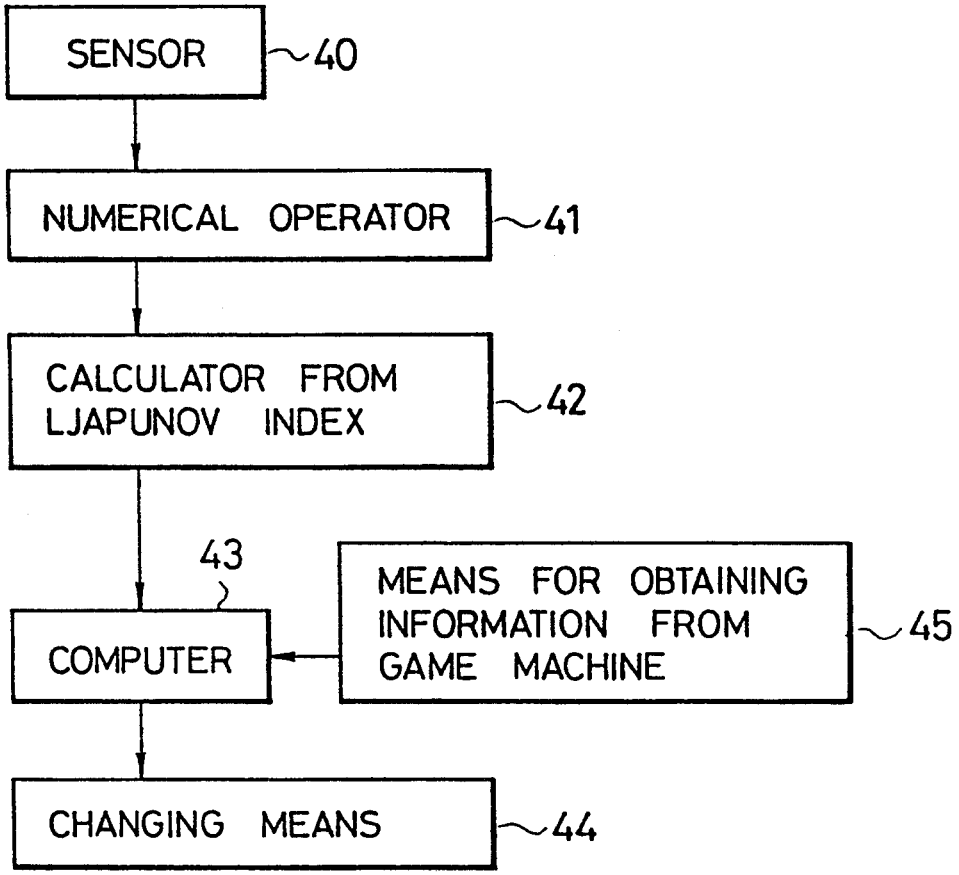
FIG. 4 is a block diagram in case the present invention is applied to the pachinko machine.

FIG. 4 is a flow chart for applying the concept of chaos of the present invention to the pachinko machine. The pulse wave data is detected from a sensor 40 used for collecting the information of the player and is converted into a chaos attractor by a numerical operation 41. The chaos attractor thus converted is then compared with a predetermined defining condition of chaos, and an index calculated by a calculator 42 from the Ljapunov index that indicates the degree of satisfying that condition is fed to a computer 43 for controlling the pachinko machine. The indication or information of this computer 43 is then fed to changing means 44 for changing the content of the game. Thus, the game content is changed according to the situation of the player at that time.

The computer 43 may be fed with the data from the pachinko machine itself as additional data. This data could be provided from a game machine interface 45 that functions to obtain information from the game machine and to provide that information to the computer 43. This data could include, for example, the reward data of balls to the rewarding catchers, the great-hit data of the game unit or the situation of the control valve of the great-hit catcher 9. The computer 43 enables the pachinko machine to cope with the various situations by processing this data and sending the commands or data for the various changes to the changing means 44.

In the present embodiment, the chaos attractor obtained from the pulse waves of the player is utilized to change the operation and responses of the pachinko machine. In order to obtain information about the psychosomatic state of the player, according to the present embodiment, the ball shooting grip 1 is equipped with a pulse wave sensor for measuring the pulse waves at the fingertip of the player.

Figure 2:
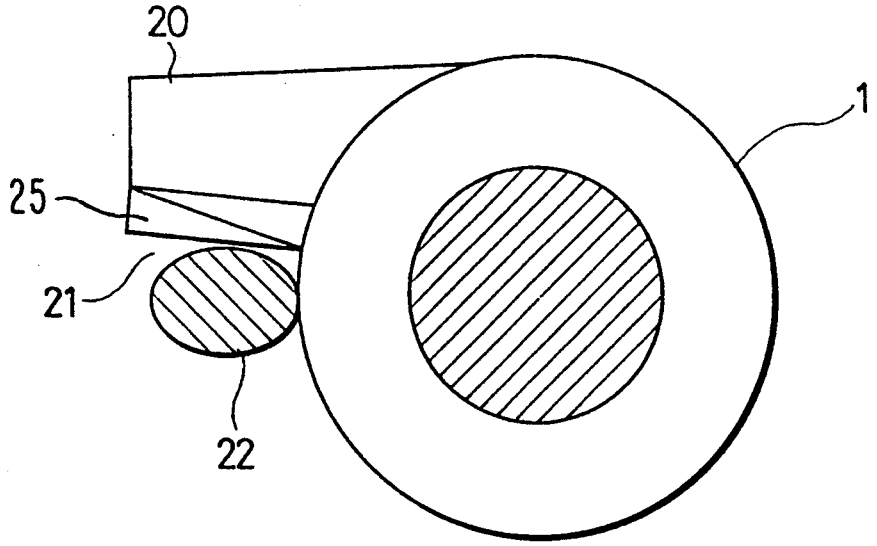
FIG. 2 is a schematic diagram showing a grip of the ball shooter of the pachinko machine of the present invention.

The ball shooting grip 1 is schematically shown in an enlarged scale in FIG. 2. This grip 1 can be turned to control the shot of the pachinko balls and the shooting intensity. The grip 1 is equipped at its outer circumference with a knob 20 to aid the turning of the knob.

The pachinko balls are usually shot by turning the grip 1 to the right. For this shooting action, the player actuates the grip 1 by applying his fingertip 22 to the lower side 21 of the knob 20. Thus, the pulse wave sensor 25 is fitted in that portion of the knob 20, at which the fingertip 22 abuts against the lower side 21.

In the present embodiment, the pulse wave sensor is composed of an infrared-emitting diode and a photosensor so that the reflection of the infrared ray emitted from the diode may be sensed by the photosensor to acquire the information of the pulse waves of the player.

Figure 3:
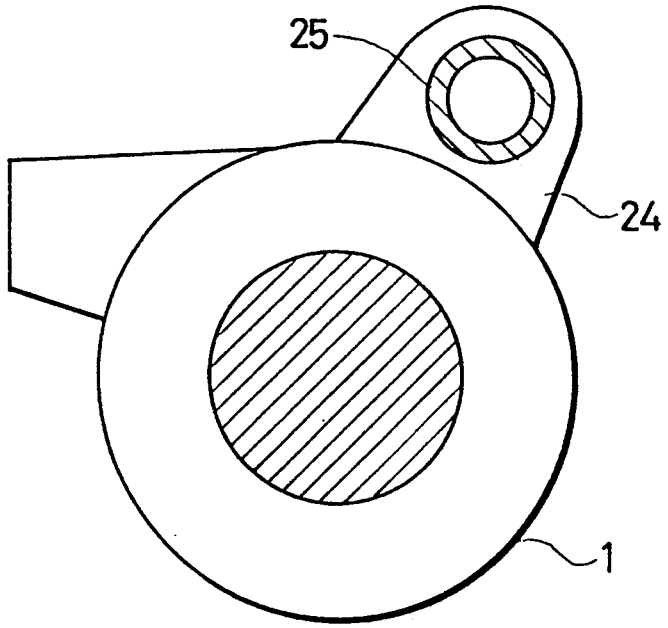
FIG. 3 is a schematic diagram showing a grip of the ball shooter of the pachinko machine of the present invention.

In an alternative mode of embodiment, the knob of the grip is formed with a finger hole 24, in which the pulse wave sensor 25 is fitted, as shown in FIG. 3. In this modification, the sensor can be held in complete contact with the fingertip so that the pulse waves of the player can be acquired more reliably.

In another structure, the pulse wave sensor can be disposed in at least such a portion of the ball shooting grip as is grasped by the player. Moreover, the sensor to be used should not be limited to that using the photocoupler but can also utilize a pressure sensor.

The pulse wave information thus achieved from the player is converted into the chaos attractor by the arithmetic operation means so that it represents the chaos attractor information that indicates the present psychosomatic state of the player. Next, the chaos attractor is compared with the predetermined chaos attractor which has already been classified and registered. Then, a Ljapunov number responding to a predetermined level is determined by the arithmetic operating means so that the responses to be taken by the pachinko machine are changed according to that numerical value.

The changes in the response and operation of the pachinko game and its game machine will be specifically described in the following. If the prevailing psychosomatic state of the player is in an "unexcited" situation and this situation is recognized through the arithmetic operator by arithmetically processing the data obtained from the aforementioned sensor, then the rewarding catcher 6, for example, other than the ordinary game unit starting chucker catcher 3 is set to operate as a concurrent game unit starting chucker catcher. Thus, the game unit is also started when a pachinko ball lands in the rewarding catcher 6. The subsequent responses of the game machine are identical to the ordinary ones in that a great hit is awarded if the specific predetermined combination is obtained among the figures. Otherwise, a predetermined number of additional balls are returned.

Thus, the psychosomatic state of the player obtained from the sensor mounted in the shooting grip is arithmetically processed to assign the game to a level corresponding to a number of predetermined levels, e.g., the "unexcited" level in this case. Then, a command is issued to alter the operation of the pachinko machine, such as a command that the game unit be started, to attract the interest of the player.

In the present embodiment, the unexpected game in the game unit is started by the pachinko machine so that the game can be changed from that of the ordinary pachinko machine and thereby results in a variations to the ordinary and expected game.

In the embodiment described above, the response of the pachinko game is changed in the game but the present invention should not be limited thereto. For example, the environmental surroundings of the player such as the air conditioning, illumination or music can also be changed to prevent the player from losing his or her interest.

Embodiment 2

The present embodiment is exemplified by applying the concept of chaos of the present invention to a rotary drum type game machine.

If the prevailing psychosomatic state of the player is in the "excited" situation, this situation is recognized through the machine or the numerical operator by arithmetically processing the data obtained from the aforementioned sensor. Then, the rotational velocity of the rotary drum type game machine can be accelerated to make the player enthusiastic in the game so that he or she may kept interested and excited in the game. Moreover, the content of the game can be changed by making the time period for the rotation of the game machine indicators shorter than the ordinary time period so that the player may see the game result earlier.

Embodiment 3

The present embodiment is exemplified by applying the concept of chaos of the present invention to the facilities of a game parlor equipped with a plurality of game machines. Specifically, the game parlor is usually arranged with a number of game machines in a block or matrix shape. These game machines are wholly or partially changed into those capable of detecting the prevailing psychosomatic states of the players. The data from these game machines is processed by another computer disposed in the game parlor to determine the distribution of the games in specific psychosomatic situations.

If a distribution of "unexcited" players is determined, for example, the kind of music being played in the parlor is changed to provide the circumstances for the players to get "excited" or "thrilled". This can fit the prevailing situations of all the players in the game parlor by changing the conditions for the entire parlor or only a portion of the parlor according to the distribution of the players in a specific state.

In all the three embodiments described above, the concept of chaos is applied, but the scope of the present invention should not be limited to the application of the concept of chaos. Even if the application of the concept of chaos is impossible, a conditional level is determined in advance to classify the players of a game machine so that the operation of the game machines can be altered in the response to the players condition, similar to the application of the concept of chaos. In this modification, various responses can be achieved by changing the predetermined level and the kinds of information detected from the players.

According to the construction of the present invention, as has been described hereinbefore, it is possible to provide the contents and circumstances of a game machine such that they conform to the prevailing psychosomatic situations of the players. Moreover, the contents, responses and circumstances of the games can be changed according to the situations of the players so that the players can continue their interests in the games for a long time without any loss. The game contents are not limited to one pattern but can be changed according to the psychosomatic situations of the players or any of the levels predetermined by the players. Thus, it is possible to realize a novel game that focuses on the players mental and emotional state.

What is claimed is:

1. A game machine comprising detecting means for detecting information indicating a psychosomatic state of a player and control means connected with said detecting means for controlling the game machine in accordance with a psychological state of the player by making use of both a chaos attractor obtained by numerically processing the information detected from the player and an index indicating the degree that the chaos attractor matches a defining condition of the chaos.

2. The machine of claim 1 further comprising balls.

3. The machine of claim 1 further comprising a indicator and the control mean controls responses of the game indicator in accordance with the psychological state of the player.

4. The machine of claim 1 wherein the detected information is physical status information including at least one of a pulse wave, a heartbeat, a bodily temperature, a pulse rate, a respiration rate, and a body weight detected from a body of the player.

5. The machine of claim 1 wherein the information is detected from at least one of a fingertip, palm, arm, head, buttock, and skin of the player.

6. A game machine comprising:

psychosomatic state detecting means including a sensor for detecting data indicating a psychosomatic state of a player from the player, chaos attractor calculating means for calculating a chaos attractor by numerically processing the data by the sensor, and Ljapunov index means for calculating an index indicating the degree that the chaos attractor matches a defining condition of chaos; and changing means for changing responses of the game machine in accordance with the data detected by the psychosomatic state detecting means.

7. The machine of claim 6 further comprising balls.

8. The machine of claim 6 further comprising a game indicator and the changing means changes responses of the game indicator in accordance with the psychological state of the player.

9. The machine of claim 6 wherein the detected data is data representative of the physical status of the player and includes at least one of a pulse wave, a heartbeat, a bodily temperature, a pulse rate, a respiration rate, and a body weigh detected from a body of the player.

10. The machine of claim 6 wherein the data is detected from at least one of a fingertip, palm, arm, head, buttock, and skin of the player.

11. The machine of claim 6 wherein the sensor includes at least one of a semiconductor pressure sensor temperature sensor, and a pulse wave sensor.

12. A game parlor comprising:

a plurality of machines each comprising psychosomatic state detecting means including a sensor for detecting data indicating a psychosomatic state of a player, chaos attractor calculating means for calculating a chaos attractor by numerically processing the data detected by the sensor, and Ljapunov index calculating means for calculating an index indicating the degree that the chaos attractor matches a defining condition of a chaos; and changing means for changing circumstances of at least one of the players and the machines in accordance with the psychosomatic states of the players detected from the psychosomatic state detecting means.

13. The parlor of claim 12 wherein the circumstances include at least one of a kind of music, volume of music, tone quality of music, brightness of illuminations, and color of illuminations.

14. The parlor of claim 12 wherein the detected data is data representative of the physical state of said player and includes at least one of a pulse wave, a heartbeat, a bodily temperature, a pulse rate, a respiration rate, and a body weight detected from a body of the player.

15. The parlor of claim 12 wherein the data is detected from at least one of a fingertip, palm, arm, head, buttock, and skin of the player.

16. The parlor of claim 12 wherein the sensor includes at least one of a semiconductor pressure sensor, a temperature sensor, and a pulse wave sensor.

17. A game machine comprising physical state sensing means for sensing the physical state of a player and assigning said physical state to a plurality of predetermined levels by utilizing information sensed from the player, and control means for controlling the game machine according to one of said predetermined levels.

18. The machine of claim 17 further comprising balls.

19. The machine of claim 17 further comprising a game indicator and the control means controls responses of the game indicator in accordance with one of the predetermined levels.

20. The machine of claim 17 wherein the detected information is physical status information including at least one of a pulse wave, a heartbeat, a bodily temperature, a pulse rate, a respiration rate, and a body weight detected from a body of the player.

* * * * *

UNITED STATES PATENT AND TRADEMARK OFFICE

CERTIFICATE OF CORRECTION

PATENT NO. : 5,395,110

DATED : March 7, 1995

INVENTOR(S) : Shunpei YAMAZAKI et al.

It is certified that error appears in the above-identified patent and that said Letters Patent is hereby corrected as shown below: On the title page: Item

[73] Assignee: Semiconductor Energy Laboratory Co., Ltd., Kanagawa-ken, JAPAN

Signed and Sealed this

Twenty-fourth Day of October, 1995

*Attest:*

Bruce Lehman

BRUCE LEHMAN

*Attesting Officer*

*Commissioner of Patents and Trademarks*